US005669835A

United States Patent [19]

Tiura

[11] Patent Number: 5,669,835

[45] Date of Patent: Sep. 23, 1997

[54] RACKET HANDLE

[76] Inventor: Oliver Tiura, 50 Etta Wylie Road, Unit 503, Etobicoke, Ontario, Canada, M8V 3Z8

[21] Appl. No.: 684,360

[22] Filed: Jul. 19, 1996

[51] Int. Cl.[6] ..... A63B 49/08

[52] U.S. Cl. ..... 473/550; 473/303

[58] Field of Search ..... 273/73 R, 735, 273/75; 473/300, 302, 303, 549, 550

[56] References Cited

U.S. PATENT DOCUMENTS

| | | | |
|---|---|---|---|
| 2,086,062 | 7/1937 | Bray | 473/302 |
| 2,205,578 | 6/1940 | Schnur | 273/75 |
| 2,210,280 | 6/1940 | Hall | 273/75 |
| 3,489,031 | 1/1970 | Meier | 74/558 |
| 4,082,276 | 4/1978 | Szafianski | 273/75 |
| 4,108,436 | 8/1978 | Masi | 273/75 |
| 4,139,195 | 2/1979 | Dreesen | 273/751 |
| 4,174,109 | 11/1979 | Gaiser | 273/81.6 |
| 4,407,500 | 10/1983 | Hoffmann | 273/75 |
| 4,907,810 | 3/1990 | Whiteford | 273/73 J |
| 5,018,733 | 5/1991 | Buand | 273/73 J |
| 5,131,652 | 7/1992 | Peng | 273/73 |
| 5,269,516 | 12/1993 | Janes | 273/73 |
| 5,374,059 | 12/1994 | Huang | 273/75 |
| 5,397,123 | 3/1995 | Huang | 473/302 X |

FOREIGN PATENT DOCUMENTS

| | | | |
|---|---|---|---|
| 337326 | 10/1989 | European Pat. Off. | 273/73 J |
| 3225481 | 1/1984 | Germany | 273/73 J |
| 3413600 | 8/1985 | Germany | 273/73 J |
| 3625929 | 2/1988 | Germany | 273/73 J |
| 4339133 | 7/1994 | Germany | 273/73 J |

*Primary Examiner*—William E. Stoll
*Attorney, Agent, or Firm*—Barrigar & Moss

[57] ABSTRACT

A racket or paddle handle for use in all racket or paddle sports that is intended to cool the user's hand and reduce the shock that occurs when a racket or paddle impacts on a ball, the handle having a handgrip comprised of a central body having concavely curved front and rear surfaces which extend a substantial distance along the handgrip, and an exterior shell dispersed on opposite sides of the central body, covering the front and rear surfaces. The shell has a plurality of ventilation openings formed therein that communicate with two separate ventilation chambers that are formed between each of the front and rear surfaces and the shell. Two air inlets are formed on opposite sides of the handgrip at a head end, each air inlet opening into a respective one of the ventilation chambers at the head end. Each ventilation chamber is substantially deeper along a central longitudinal portion than along an end portion that is adjacent a butt end of the handgrip. In a preferred embodiment, the exterior shell of the handle is part of a single integral unit that includes the air intakes. The integral unit also forms a head on which racket strings are mounted.

19 Claims, 3 Drawing Sheets

RACKET HANDLE

BACKGROUND OF THE INVENTION

This invention relates to rackets and paddles for use in racket and paddle sports such as tennis and paddle ball.

Many racket and paddle sports, such as tennis, squash, racketball, and paddle ball require substantial physical exertion of a player during the course of play. Frequently, this results in profuse perspiration, especially by the racket or paddle holding hand. As a result, it is often difficult for a player to hang onto and maintain control of conventional rackets and paddles as the build up of perspiration can result in a significant reduction of friction between the user's hand and the grip of the handle. During play, the handle structure begins to warm up and retain accumulated heat, which further exacerbates the problem. Occasionally, a player may find that the combination of heat, perspiration and contact with the handle can result in irritation of the skin of his or her hand. During the match, the hand, arm and elbow of a player's racket arm is repeatedly subjected to a jarring shock each time the racket head impacts on the ball. The repetitive shock being applied to the player's arm everytime a ball is hit, which can be as often as every two seconds in a tennis match, can and often does result in injury to the hand, armor elbow of the player.

In the prior art, various handle designs for rackets have been disclosed with ventilation and shock absorbing features but, for various reasons, none have proved to be particularly successful in practice. For example, U.S. Pat. No. 4,907,810 issued May 13, 1990 to C. L. Whiteford discloses a ventilated and shock absorbing racket handle construction comprised of a rigid tubular shell having a large number of small holes in its surface area and a handle shank mounted in the shell. Air passages are provided between the handle shank and the shell and air can enter these passages through the holes contained in the shell. The shell is wrapped with a leather member also containing a plurality of holes. However, the racket handle in the Whiteford patent relies on random alignment of the holes in the leather wrapping member and the holes in the shank member which often results in few holes in the shell being left open. Furthermore, it is believed that the air passageways and small holes disclosed in the Whiteford patent are not sufficient enough to result in the air flow required to satisfactorily cool a user's hand.

U.S. Pat. No. 5,018,733 issued May 28, 1991 to T. M. M. Buand discloses a handgrip for a racket for ball games that includes a narrow ventilation chamber formed between the body of the handgrip and a sleeve surrounding the grip. However, the outer sleeve is flexible, resulting in the volume of the narrow chamber being varied by the pressure exerted by a player's hand. Again, the construction is such that the airflow in the grip will be insufficient to cool a user's hand or satisfactorily absorb shock.

Therefore, there exists a need for a racket or paddle handle which is able to satisfactorily cool and dry a user's hand, to absorb some of the jarring impact that occurs when a ball is hit, and to also have desirable handling and playing characteristics for the playing of the racquet or paddle sport. The handle of the present invention is intended to provide at least some of these desirable features.

SUMMARY OF THE INVENTION

According to one aspect of the invention, a ball hitting device for a ball game such as tennis and paddle ball, the device having a generally wide and flat head portion and a handgrip connected to the head portion. The handgrip is comprised of a central body having concavely curved front and rear surfaces which extend a substantial distance along the handgrip. An exterior shell is disposed on opposite sides of the central body and covers the front and rear surfaces. The shell has a plurality of ventilation openings formed therein that communicate with two separate ventilation chambers that are formed between each of the front and rear surfaces and the shell. Two air inlets are formed on opposite sides of the handgrip at a head end thereof, each air inlet opening into a respective one of the ventilation chambers at the head end. Each ventilation chamber is substantially deeper along a central longitudinal portion than along an end portion that is adjacent a butt end of the handgrip.

In a preferred embodiment, an air passageway extends between the two ventilation chambers near the butt end of the handgrip and the concave surfaces extend longitudinally to points near the butt end of the handgrip.

In another preferred embodiment, the ventilation openings of the ball game racket are primarily located in a section of the shell extending from the butt end of the handgrip to a transverse plane located about midway between the butt end and the air inlets.

In another preferred embodiment, the exterior shell of the racket or paddle is made as a single integral unit where the air inlets are formed in the integral unit and the integral unit also forms a racket head on which racket strings are mounted.

Preferably an inwardly projecting lip is formed on the shell along one side of each air inlet of the ball game racket. Each lip is preferably formed on the side of its respective air inlet closest to the butt end of the handgrip. The exterior shell of the handle is preferably covered by a flexible, plastic layer which has perforations aligned with the ventilation openings.

According to another aspect of the invention, a handle assembly for a ball hitting device for a ball game is provided. The handle assembly is suitable for a racket or paddle and comprises a central elongate body having front and rear surfaces which extend generally longitudinally in the handle assembly. A rigid exterior shell extends over the front and rear surfaces and is generally spaced therefrom so as to form two separate ventilation chambers. The shell is rigidly connected to the elongate body and has a plurality of small ventilation openings formed therein. Two air inlets are formed on opposite sides of the handle assembly at a head end of the shell at which a head portion of the hitting device can be connected. Each air inlet opens into a respective one of the ventilation chambers at one end thereof. An air passageway is formed in the handle assembly adjacent a butt end of the elongate body, the passageway extending between the ventilation chambers and permitting a restricted amount of air to flow from the other end of each ventilation chamber to the other ventilation chamber during use of the ball hitting device. The amount of airflow is restricted by the small size of the passageway along at least a portion or portions thereof.

According to a further aspect of the invention, a ball hitting device for a ball game, such as tennis and paddle ball, has a generally wide and flat head portion and a handgrip connected to the head portion. The handgrip is comprised of a central body having front and rear surfaces which extend longitudinally a substantial distance along the handgrip. An exterior shell is disposed on opposite sides of the central body and is connected thereto, the shell having a plurality of small ventilation openings formed therein. Two elongate ventilation chambers are formed between the shell and the front and rear surfaces of the body, and two air inlets, which are larger than the ventilation openings, are formed on respective front and rear sides of the handgrip at a head portion end thereof. Each air inlet opens into a respective one of the ventilation chambers so as to allow air to flow into the chamber and out of at least some of the ventilation openings during use of the ball hitting device. Each air inlet has an elongate inwardly projecting lip extending along a side of the inlet closest to a butt end of the handgrip, the lip being provided to reduce the sound caused by the respective air inlet during use of the ball hitting device.

The present invention will be understood and appreciated more fully from the following detailed description, taken in conjunction with the accompanying drawings.

DETAILED DESCRIPTION OF PREFERRED EMBODIMENTS

Figure 1:
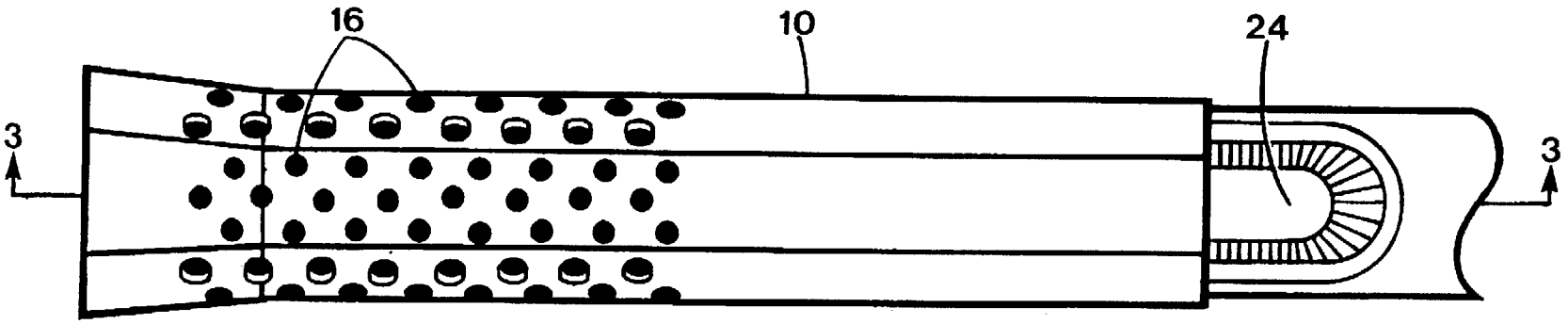
FIG. 1 is a front view of a handle for a racket or paddle constructed in accordance with the invention.
Figure 2:
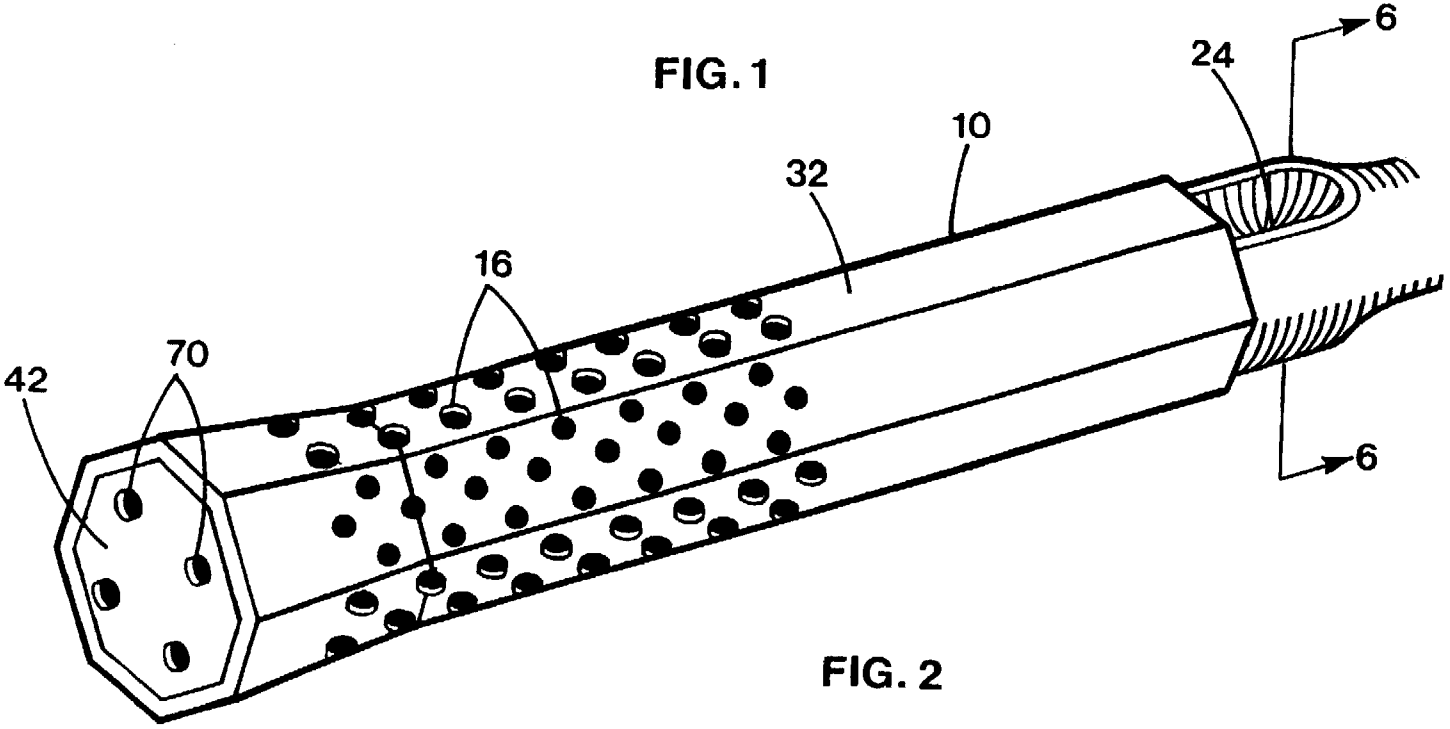
FIG. 2 is a perspective view of the racket or paddle handle.
Figure 6:
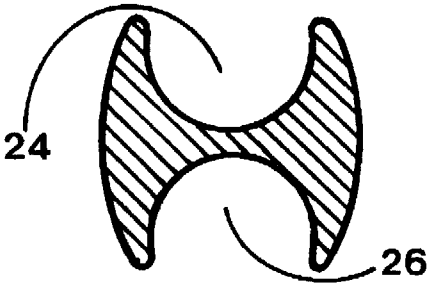
FIG. 6 is a transverse cross-section taken along the line 6—6 of FIG. 2.

A handle or handgrip 10 on a ball racket comprises a central body 12 having concavely curved front 36 and rear 37 surfaces, and an elongate, rigid exterior shell 14. Two separate ventilation chambers 20 and 22 are formed in the handle 10 between the front 36 and rear 37 surfaces of the central body 12 and the exterior shell 14. The chambers 20, 22 extend substantially the length of the gripping surface. The exterior shell 14 has a plurality of small ventilation holes 16 and 18 formed therein and two relatively large air inlets 24 and 26 are formed on opposite sides of the handgrip. The ventilation holes 16 and 18 and the air inlets 24 and 26 open respectively into the two separate ventilation chambers 20 and 22. The two ventilation chambers 20 and 22 are preferably connected by an air passageway 28 that extends between the two ventilation chambers 20 and 22 near the butt end 42 of the handle. The ventilation holes 16 and 18 are located primarily in the portion of the handle 10 that is normally gripped by a user's hand. In a tennis racket the portion that is generally gripped is the lower section of the hand grip extending from the butt end to about midway between this end and the air inlets 24 and 26.

It will be understood that the present invention can be used for handles for tennis rackets and also for paddles used in ball games such as paddle ball and pingpong. In its broad aspects the handle of the invention can be used in ball hitting devices used in a ball game such as tennis and paddle ball, which devices have a generally wide and flat head portion (not shown).

Preferably each of the curved surfaces 36, 37 forms a smooth, substantially continuous curve from its forward end 92 at one side of the air inlet to its rear end 94. Thus, each ventilation chamber is substantially deeper along a central longitudinal portion thereof than along opposite end portions thereof. In the illustrated handle, each surface 36, 37 is more steeply curved at 96 in the vicinity of the air inlet to permit as much air as possible to enter the ventilation chamber and at the same time direct the airflow to move longitudinally through the chamber towards the butt end. Each surface 36, 37 is gently curved at 98 in order to gradually compress the airflow while maintaining the speed and direction of the airflow as much as possible.

Preferably, the exterior shell 14 and the central body 12 are made from a strong, rigid material such as graphite or other composite plastics. The exterior shell 14 preferably is covered by a flexible, plastic or leather layer or wrap 32 which has perforations aligned with the ventilation openings 16 and 18. The plastic or leather layer 32 may comprise a strip of material, similar to that used for grip handles in conventional rackets, that is wrapped around the exterior shell 14 of the racket handle 10. The use of this material helps to absorb shock when the racket strikes a ball, thus reducing the likelihood of injury to the user's arm and elbow.

Preferably, a curved inwardly projecting lip 30 is formed on the exterior shell 14 on the side of each air inlet 24 and 26 that is closest to the butt end of the handgrip. It will be understood that each air inlet lies substantially in a plane that is approximately parallel to the aforementioned flat head portion. The lip need not necessarily be curved as shown but can also be square or rectangular in cross-section. The use of the lip 30 helps reduce any sound or sound effect caused by the respective inlet during fast movements of the racket or paddle, which sounds might otherwise be annoying or distracting to some players. The lip is preferably curved as shown as this will result in improved air intake into the inlets 24 and 26 due to the improved aerodynamic flow over a smoothly curved lip.

Figure 3:
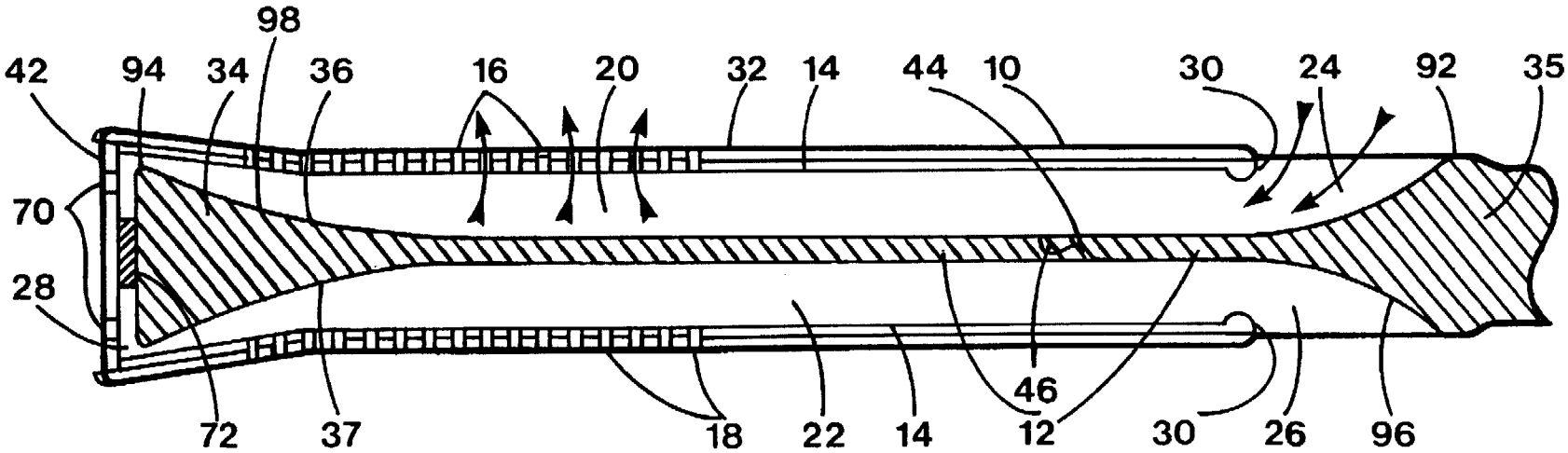
FIG. 3 is a cross-sectional view of the racket or paddle handle, taken substantially along the line 3—3 in FIG. 1.
Figure 4:
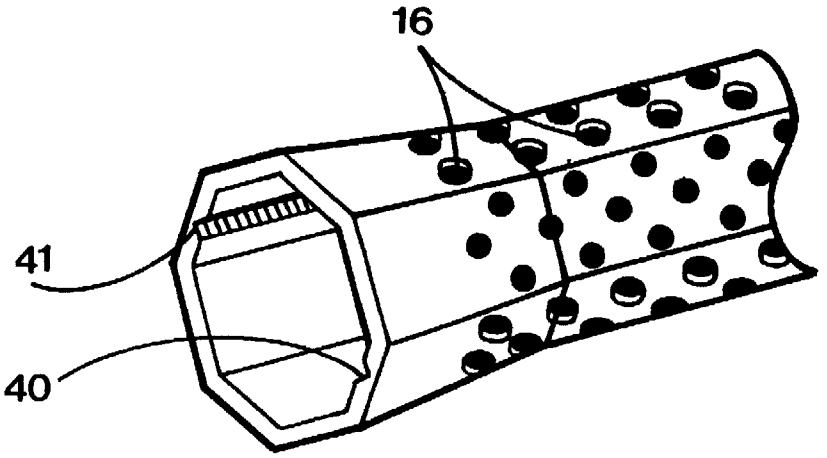
FIG. 4 is a perspective view of a lower half or butt end half of the exterior shell only without its flexible covering and with a butt end plate and central body removed.
Figure 5:
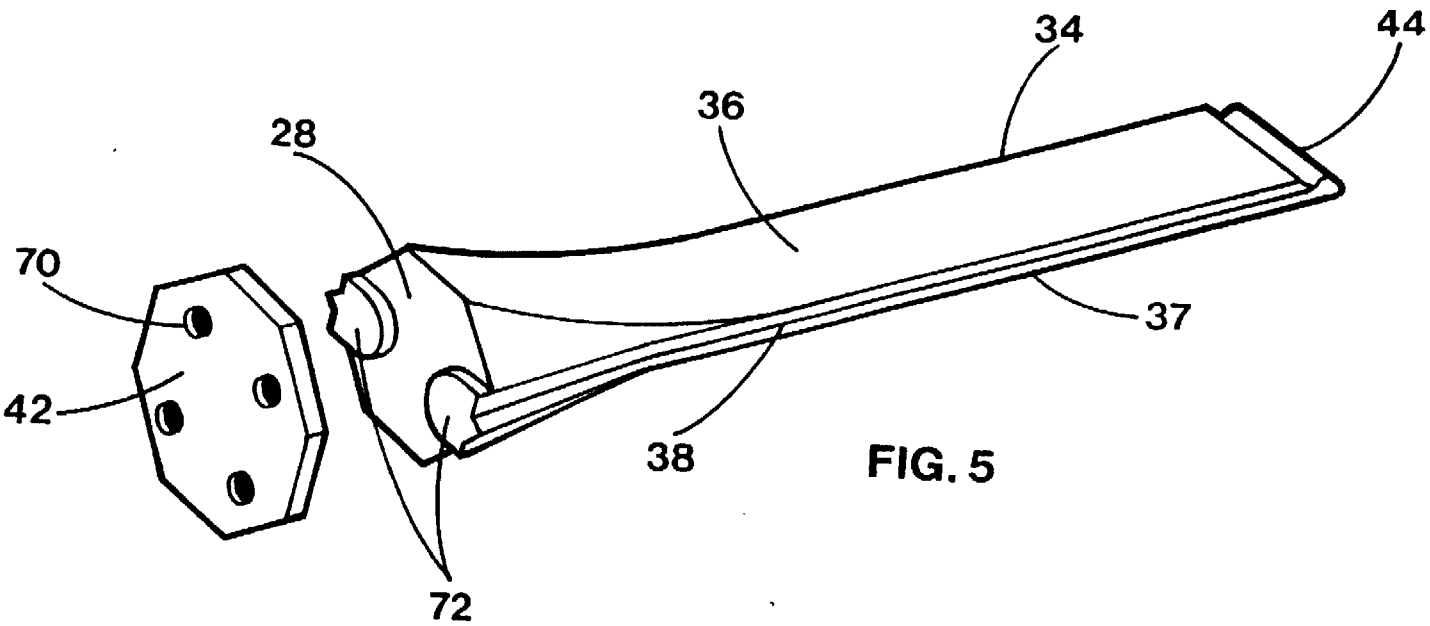
FIG. 5 is a perspective view of a major portion of the central body of the racket handle with the butt end plate moved outwardly to show passageways near the butt end of the handle.

One preferred form of racket is substantially assembled from only two pre-formed molded parts, one part being comprised of a major portion of the central body 12 that is a wedge shape member 34 (see FIG. 5), the other part being comprised of the exterior shell 14 (see FIG. 3), the remaining portion 35 of the central body 12, and the head portion on which the usual racket strings are mounted. The wedge shaped member 34 has curved front 36 and rear 37 surfaces and two opposite sides that each have an elongate ridge 38 extending lengthwise along the length of the wedge-shaped member 34. Preferably each ridge 38 has a triangular cross-section as shown. The two ridges 38 of the wedge-shaped member 34 are each received in a respective groove 40, 41 that is formed in the exterior shell 14, thereby connecting the exterior shell 14 and the wedge shaped member 34 together. Adhesive can also be used to strengthen the connection between the body and the shell. The end of the wedge shaped member 34 closest to the head end of the racket has a double curved edge 44 that is received by a corresponding edge 46 of the portion 35 of the central body 12 (see FIG. 3). The wedge shaped portion 34 includes a butt plate 42 which covers the air passageway 28 between the ventilation chambers 20 and 22. The cross-sectional area of the air passageway 28 is substantially less than the average cross-sectional area of the ventilation chambers 20 and 22. Two flat, integral spacers 72 are formed at the rear of the member 34 in order to form the air passageway 28.

Although the exterior shell 14 and portion 35 can be manufactured as a single integral unit that also includes the racket head, it is also possible to make these components separately and to connect them together in a strong, rigid manner. It will be appreciated that the illustrated two piece construction of the racket handle provides for a durable and strong racket structure that is relatively easy to manufacture and assemble.

In operation, the handle 10 of the present invention cools and reduces perspiration from the hand of a user and absorbs some of the shock that occurs when a ball is hit. Referring to the figures, when the handle 10 is swung in a forward motion, air is forced through the air inlet 24 into the ventilation chamber 20. As the air flows through the ventilation chamber 20 towards the butt-end of the racket handle 10, the depth and the cross-sectional area of the ventilation chamber 20 decrease, thus resulting in increased air pressure towards the butt end. The air pressure in the chamber causes a certain amount of air to flow through at least some of the ventilation holes 16 which are located in the front surface of the exterior shell 14 of the racket handle 10, particularly those holes not covered by a user's hand. Preferably, an air passageway 28 permits a restricted amount of the air flowing through the ventilation chamber 20 to pass or be drawn through the butt-end into the ventilation chamber 22. Once the air flows into ventilation chamber 22, some of it exits through the ventilation holes 18 which are located in the rear surface of the shell 14. Additionally, some of the air will flow out through the air inlet 26 on the rear of the shell 14.

It will be understood that by swinging the racket handle 10 in a forward direction, positive air pressure is applied at air inlet 24 and negative air pressure or suction is created at air inlet 26 and ventilation holes 18, thus providing the force necessary to move the air through the racket handle 10 in the manner described above. It will further be appreciated that the airflow direction described above will generally be reversed when the racket is swung in a backwards direction. During a back swing, the air will flow into the ventilation chamber 22 via the air inlet 26, then some will flow out through the air outlets 18 and a restricted amount will flow through the air passageway 28 into the ventilation chamber 20 and finally out of the air inlet 24.

During each forward swing and back swing of the handle, a flow of air is forced through some of the ventilation holes 16 and 18 thereby providing a cool flow of fresh air on the hand of the user that is gripping the handle 10. During a forward swing, a greater amount of air exits through the ventilation holes 16 and during a back swing, a greater amount of air exits through the ventilation holes 18. As a result, the user's hand is cooled and perspiration from the user's hand is both reduced and removed, thereby allowing the user to have an increased control over the racket or paddle and avoiding irritation to the skin surface of his or her hand. The flow of air through the handle during each swing also acts to cool and reduce thermal build-up in the handle 10 itself.

Additionally, the flow of air from the ventilation chambers 20 and 22 out through the holes 16 or 18 is believed to create a thin cushion of air between the outer layer 32 and the user's hand, which cushions the vibrations and oscillations that occur in the handle 10 when a ball is hit. The cushioning effect of the air that is flowing out of the racket or paddle handle 10 may help to reduce incidents of injury and strain that may occur in a user's hand and arm during racket sports.

It will be appreciated that the ventilation chambers 20 and 22 and the air inlets 24 and 26, together with the ventilation holes 16 and 18 are dimensioned to allow an optimal amount of fresh air to flow through the racket handle 10 and out of the ventilation holes 16 and 18, while at the same time providing for a strong and durable racket construction. A person who is skilled in the art will appreciate that varying the depth and thus the cross-section of the ventilation chambers 20 and 22 provides for an efficient means of forcing air through the ventilation holes 16 and 18 when the handle 10 is swung. Further, the large, open air inlets 24 and 26 provide efficient devices for scooping outside air into the ventilation chambers. In addition, the swinging action of the racket results in fresh air being compressed to some extent as it passes through the ventilation chamber. As compressed air is naturally cooler, this fact will also act to cool the shell and the outer cover.

Because of the possibility of water entering the hollow handle during use of the racket, particularly in wet weather, it is desirable to provide drainage holes 70 for the water to drain out. Four small holes 70 can be formed in the corners of the butt plate 42 for this purpose. These holes can be located adjacent the passageway 28.

Although the holes 16 and 18 as illustrated are round, clearly they can have other shapes including square and rectangular. They should not be so numerous or so big as to weaken the strength and rigidity of the shell or to lessen its ability to support the flexible outer wrap or cover 32.

It will be appreciated by persons skilled in the art that the present invention is not limited by what has been particularly shown and described herein. Rather, the scope of the present invention is defined only by the claims which follow:

I therefore claim:

1. A ball hitting device for a ball game such as tennis or paddle ball, said device having a generally wide and flat head portion and a handgrip connected to said head portion, said handgrip comprising:

a central body having concavely curved front and rear surfaces which extend longitudinally a substantial distance along said handgrip;

an exterior shell disposed on opposite sides of said central body and covering said front and rear surfaces, said shell having a plurality of ventilation openings formed therein and communicating with two separate ventilation chambers formed between each of said front and rear surfaces and said shell; and two air inlets formed on opposite sides of said handgrip at a head end thereof, each air inlet opening into a respective one of said ventilation chambers at a head end thereof, wherein each ventilation chamber is substantially deeper along a central longitudinal portion thereof than along an end portion thereof adjacent a butt end of the handgrip.

2. A ball hitting device according to claim 1 wherein an air passageway extends between said two ventilation chambers near said butt end of the handgrip and said concavely curved surfaces extend longitudinally to points near said butt end of the handgrip.

3. A ball hitting device according to claim 2 wherein said exterior shell is substantially covered by a flexible, resilient plastic layer which has perforations aligned with said ventilation openings.

4. A ball hitting device according to claim 2 wherein said central body and said exterior shell are made from a strong, rigid plastic material and are fixed in their positions relative to each other.

5. A ball hitting device according to claim 4 wherein a major portion of said central body comprises a wedge-shaped member having curved front and rear surfaces and two opposite sides extending between these front and rear surfaces, said opposite sides each having an elongate ridge extending lengthwise of said central body, and wherein said exterior shell has two elongate grooves formed in opposite sidewalls thereof, each ridge being received in a respective one of said grooves in order to connect said wedge-shaped member to said shell.

6. A ball hitting device according to claim 4 wherein said ventilation openings are primarily located in a section of said shell extending from said butt end of the handgrip to a transverse plane located about midway between said butt end and said air inlets.

7. A ball hitting device according to claim 1 wherein said ventilation openings are primarily located in a section of said shell extending from said butt end of the handgrip to a transverse plane located about midway between said butt end and said air inlets.

8. A ball hitting device according to claim 1 wherein said exterior shell is made as a single integral unit, said air inlets being formed in said integral unit, and wherein said integral unit also forms said head portion on which racket strings are mounted.

9. A ball hitting device according to claim 1 wherein an inwardly projecting lip is formed on said shell along one side of each air inlet.

10. A ball hitting device according to claim 9 wherein each lip is formed on the side of its respective air inlet closest to said butt end of the handgrip.

11. A handle assembly for a ball hitting device for a ball game, said handle assembly being suitable for a racket or paddle and comprising:

a central elongate body having front and rear surfaces which extend generally longitudinally in the handle assembly;

a rigid exterior shell extending over said front and rear surfaces and generally spaced therefrom so as to form two separate ventilation chambers, said shell being rigidly connected to said elongate body and having a plurality of small ventilation openings formed therein;

two air inlets formed on opposite sides of said handle assembly at a head end of said shell at which a head portion of said hitting device can be connected, each air inlet opening into a respective one of said ventilation chambers at one end thereof; and an air passageway formed in said handle assembly adjacent a butt end of said elongate body, said passageway extending between said ventilation chambers and permitting a restricted amount of air to flow from the other end of each ventilation chamber to the other ventilation chamber during use of said ball hitting device, the amount of air flow being restricted by the small size of said passageway along at least a portion or portions thereof;

wherein said front and rear surfaces each curve outwardly to a point close to said exterior shell at said butt end, at least one entry to said air passageway being formed by a gap between said elongate body and said exterior shell at said butt end.

12. A handle assembly according to claim 11 wherein said front and rear surfaces each curve outwardly to a head portion side of a respective air inlet.

13. A handle assembly according to claim 11 wherein said ventilation openings are primarily located in a section of said shell extending from a transverse plane at said butt end to a transverse plane located about midway between said butt end and said air inlets.

14. A handle assembly according to claim 11 wherein said two air inlets are substantially larger than said ventilation openings and said shell is substantially covered by a flexible plastic layer which has perforations aligned with said ventilation openings.

15. A ball game racket having a handle assembly according to claim 11 and a head portion on which racket strings are mounted, wherein said exterior shell is made as a single integral plastic unit in which said air inlets are formed, said integral unit also forming said head portion.

16. A ball hitting device for a ball game such as tennis or paddle ball, said device having a generally wide and flat head portion and a handgrip connected to said head portion, said handgrip comprising:

a central body having front and rear surfaces which extend longitudinally a substantial distance along said handgrip;

an exterior shell disposed on opposite sides of said central body and connected thereto, said shell having a plurality of small ventilation openings formed therein;

two elongate ventilation chambers formed between said shell and said front and rear surfaces of the central body; and two large air inlets, which are substantially larger than said ventilation openings, formed on respective front and rear sides of said handgrip at a head portion end thereof, each air inlet opening into a respective one of said ventilation chambers so as to allow air to flow into the chamber and out of at least some of said ventilation openings during use of said ball hitting device, and each air inlet lying substantially in a plane that is approximately parallel to said flat head portion;

wherein each air inlet has an elongate, inwardly projecting lip extending along a side of the inlet closest to a butt end of the handgrip, said lip being provided to reduce any sound caused by the respective air inlet during use of said ball hitting device.

17. A ball hitting device according to claim 16 wherein each lip is formed on said exterior shell and projects inwardly from an adjacent inner surface of said exterior shell.

18. A ball hitting device according to claim 17 wherein each lip is curved as viewed in a transverse cross-section of the lip so as to have a smoothly rounded exterior.

19. A ball hitting device according to claim 16 wherein said exterior shell is made of a strong, relatively rigid, plastic material and said shell is substantially covered by a flexible, plastic layer which has perforations aligned with said ventilation openings.

* * * * *